US005535109A

United States Patent [19]

Moore et al.

[11] Patent Number: 5,535,109

[45] Date of Patent: Jul. 9, 1996

[54] QUARTZ HALOGEN FLOOD LIGHT ASSEMBLY HAVING IMPROVED HOUSING

[75] Inventors: Clyde R. Moore, Germantown; William A. Fredrick, Cordova, both of Tenn.; J. D. McIngvale, Hernando, Miss.; Mark T. Wedell, Germantown, Tenn.

[73] Assignee: Thomas & Betts Corporation, Memphis, Tenn.

[21] Appl. No.: 235,728

[22] Filed: Apr. 29, 1994

[51] Int. Cl.[6] ..... F21V 21/14

[52] U.S. Cl. ..... 362/267; 362/226; 362/269; 362/457

[58] Field of Search ..... 362/226, 267, 362/269, 287, 368, 418, 427, 457

[56] References Cited

U.S. PATENT DOCUMENTS

| | | | |
|---|---|---|---|
| 1,764,930 | 6/1930 | Byck | 362/267 |
| 2,240,634 | 5/1941 | Winkler | 362/267 |
| 2,786,129 | 3/1957 | Mears | 362/267 |
| 3,560,728 | 2/1971 | Atkin | 240/3 |
| 3,571,587 | 3/1971 | Hilzen | 240/11.4 |
| 3,751,657 | 8/1973 | Sangiamo et al. | 240/41.35 E |
| 3,832,540 | 8/1974 | Roth | 240/51.11 R |
| 4,288,846 | 9/1981 | Fletcher et al. | 362/217 |
| 4,315,302 | 2/1982 | Petralia | 362/226 |
| 4,410,931 | 10/1983 | Decandia et al. | 362/267 |
| 4,564,783 | 1/1986 | Krieg et al. | 313/113 |
| 4,574,337 | 3/1986 | Poppenheimer | 362/267 |
| 4,590,542 | 5/1986 | Schauwecker | 362/226 |
| 4,683,523 | 7/1987 | Olsson et al. | 362/267 |
| 4,755,711 | 7/1988 | Fields et al. | 313/111 |
| 4,918,582 | 4/1990 | McIngvale et al. | 362/267 |
| 4,996,635 | 2/1991 | Olsson et al. | 362/267 |
| 5,243,507 | 9/1993 | Atkins et al. | 362/376 |

FOREIGN PATENT DOCUMENTS 919993 2/1963 European Pat. Off. .

OTHER PUBLICATIONS

Inventor Wedell's sketch representing his knowledge of prior art General Motors Dual Headlight Assembly, Apr. 1994.

Sylvania Capsylite® PAR 38 Lamps Data Sheet, one page, undated.

*Primary Examiner*—Denise L. Gromada
*Assistant Examiner*—Y. Quach
*Attorney, Agent, or Firm*—Salvatore J. Abbruzzese

[57] ABSTRACT

A quartz halogen outdoor floodlight assembly, having an improved lamp, reflector, and housing therefor for increased adjustability and overall performance. The housing comprises a two component unit, having upper and lower separable housing members, interconnected through a quarter turn fastening system comprising at least one key extending from the lower housing member, a receiving keyway formed in the upper housing member, and a camming ramp formed internally in the upper housing member. A lens in secured to the face of the upper housing member by a sealing adhesive, which simultaneously retains a reflector within the upper housing. A lamp operatively secured within a socket disposed in the lower housing member is operatively positioned in the reflector upon assembly. The lamp preferably includes an internal reflector which aligns with the external reflector to increase longitudinal light output.

18 Claims, 3 Drawing Sheets

QUARTZ HALOGEN FLOOD LIGHT ASSEMBLY HAVING IMPROVED HOUSING

FIELD OF THE INVENTION

The present invention relates to lighting fixtures and, more particularly, to a sealed fixture having a sealed, two-piece separable housing with an improved reflector and fastening system.

BACKGROUND OF THE INVENTION

Outdoor flood lights are commonly used in both residential and commercial settings for increased security and improved appearance. For years, most outdoor flood lights have utilized large incandescent bulbs, which perform acceptably well under most circumstances. In a typical conventional fixture, two such bulbs, commonly referred to in the industry as "PAR 38" lamps, are provided on a single base, with each bulb being retained by a socket secured to the base through a hinged connector providing multiple degrees of adjustability.

In more recent years, quartz halogen lamps have become increasingly popular for use in outdoor flood lights, due to their attractive appearance, increased light generation, superior efficiency (measured in lumens/watt), and longer life. Quartz halogen flood light assemblies typically comprise a single fixture adjustably mounted on a base, utilizing a dual-end lamp horizontally mounted within a rectangular housing, as shown, for example, in U.S. Pat. Nos. 4,410,931 issued Oct. 18, 1983 to De Candia et al., and 3,832,540 issued Aug. 27, 1974 to Roth.

It has been discovered that conventional quartz halogen fixtures have at least two significant drawbacks. First, due to the relatively large size of the housing required for a dual-end lamp, it is not feasible to include two housings in a single assembly for most applications. Therefore, the area to be lighted by a single assembly is significantly reduced. Second, dual-end lamps must be maintained in a substantially horizontal position in order to avoid a significant reduction in life span. Accordingly, a conventional quartz halogen fixture is severely limited in its degrees of adjustability. These disadvantages, particularly when combined, may severely reduce the feasibility of quartz halogen flood lights for many users and in many applications.

Conventional quartz halogen flood light fixtures comprise a single component housing, having a removable lens secured to its face. Replacement of the lamp typically requires removal of the lens by disengaging a plurality of clamps or latches disposed around its perimeter. It has also been recognized that such fixtures are comparatively expensive, due to their size and number of components. Furthermore, lamp replacement typically requires an inordinate number of steps for removal and replacement of the lens.

Single-end quartz halogen lamps are produced in a variety of configurations, some with an internal, laterally oriented reflector such as that shown in U.S. Pat. No. 3,555,338 to Scoledge et al., issued Jan. 12, 1971. Others, such as that shown in U.S. Pat. No. 4,280,076 to Walsh issued Jul. 21, 1981, disclose a longitudinally oriented reflector whose primary purpose is to increase efficiency by reflecting infrared energy back to the filament. Neither of these devices discloses the use of an internal, longitudinally oriented reflector secured to the filament for use in increasing light projection in the longitudinal direction, particularly in cooperation with an external reflector.

SUMMARY OF THE INVENTION

An object of the present invention is to provide a two-piece housing for a quartz halogen flood light fixture.

Another object is to provide an improved assembly system for a two-piece light fixture housing.

A further object is to provide a quartz halogen lamp housing having improved heat dissipation characteristics.

A still further object is to provide a quartz halogen light fixture housing having increased light projection capabilities.

Still another object is to provide simplified access to the lamp contained within a two-piece fixture housing.

Still another object is to provide simplified access to the lamp within a two component housing.

In order to achieve these and other objects, the present invention comprises a quartz halogen flood light assembly having a pair of light fixtures secured to multi-adjustable mounting arms attached to a single base. Each housing contains a single ended quartz halogen lamp having an internal reflector for improved performance. Each fixture is uniquely divided into first and second separable housing components, interconnected through a built-in, automatically sealing quarter turn fastening system.

In the preferred embodiment disclosed herein, a lens is permanently affixed to the outer housing member by a novel method which simultaneously retains a reflector within the housing. According to the method of this invention, the reflector is placed in a position with its outer, annular flange disposed adjacent a channel formed in the face of the housing, a quantity of sealing adhesive is placed in the channel, and the lens is pressed thereon. Upon curing, the adhesive seals the housing member and retains the lens and reflector in their operative positions.

Upon assembly of the first and second housing components, the internal lens reflector is substantially aligned with the external reflector to maximize light output, and minimize the amount of light directed into the bottom of the housing. The external reflector has a downwardly protruding lip which surrounds the lower portion of the lamp to further reduce the transmission of light into the housing.

The above stated and other objects will become apparent to those skilled in the art upon reading the following detailed description in conjunction with the appended drawings.

DETAILED DESCRIPTION OF THE PREFERRED EMBODIMENT

Figure 1:
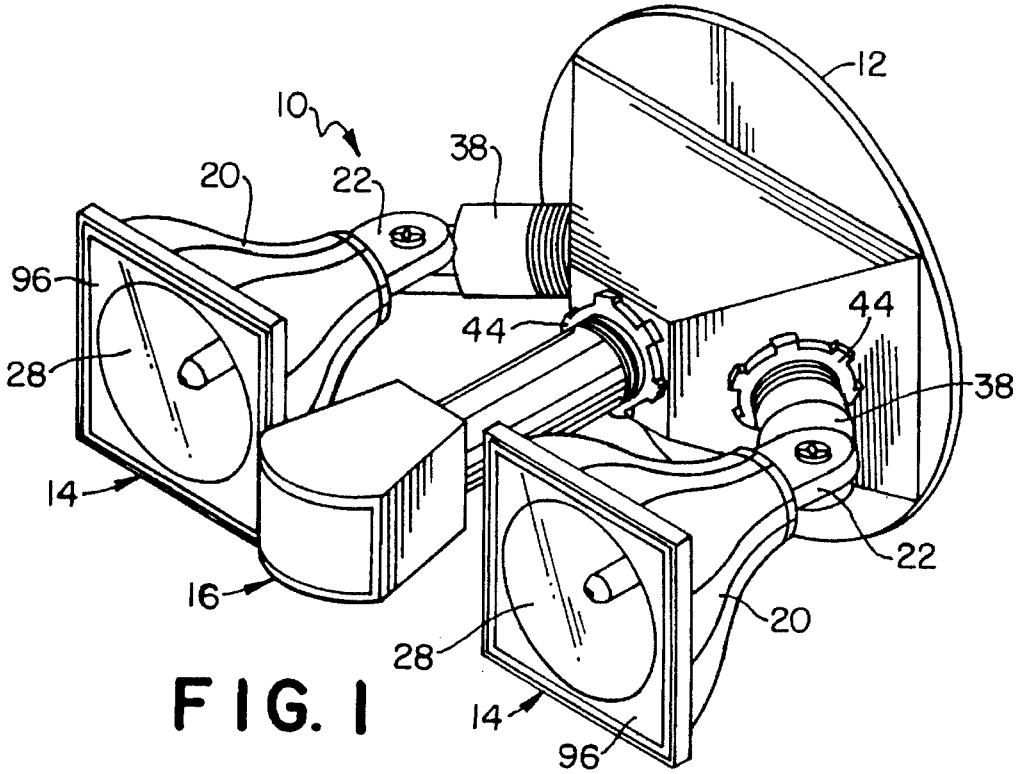
FIG. 1 is a top, side perspective view of the lighting fixture of the present invention.
Figure 2:
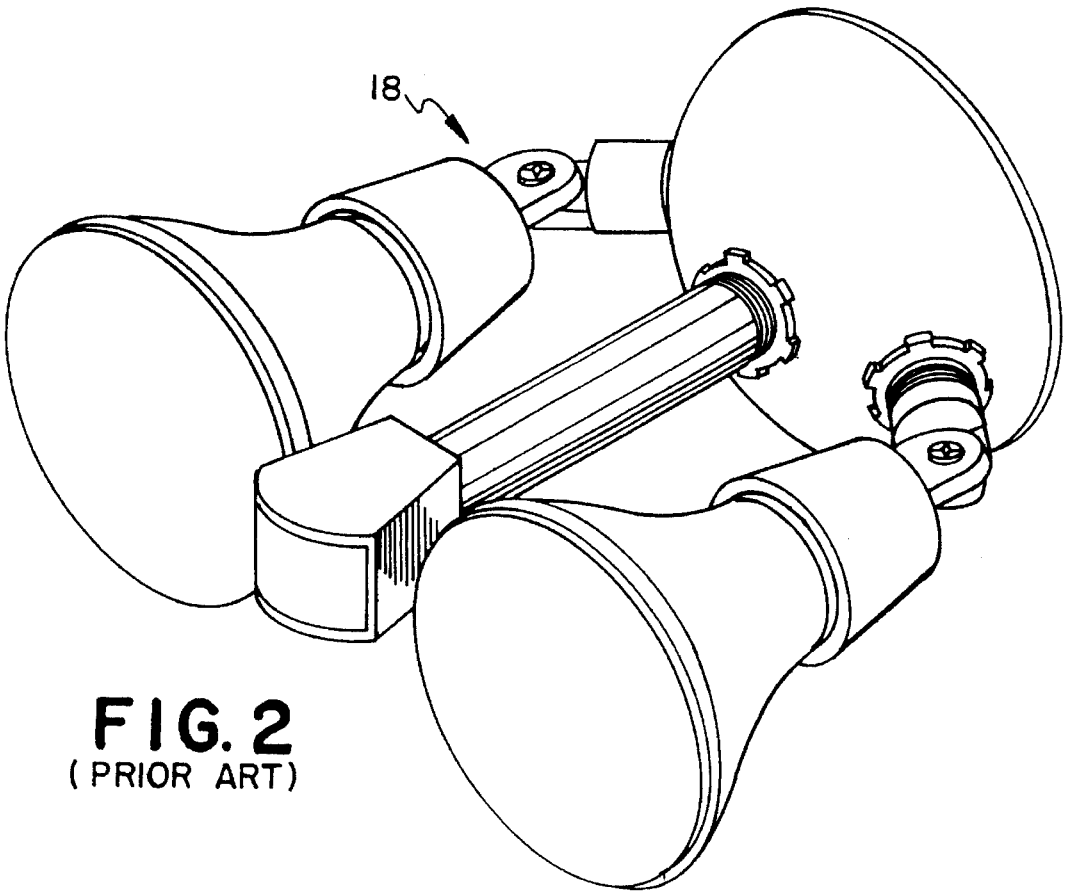
FIG. 2 (PRIOR ART)
FIG. 2 is a top, side perspective view of a conventional, prior art flood light assembly.

Referring initially to FIG. 1, outdoor lighting assembly 10 is shown comprising a base plate 12 and a pair of identical lighting fixtures 14. The preferred embodiment of assembly 10 also includes a conventional motion sensor 16, the operation of which is well known to those skilled in the art and, therefore, need not be disclosed herein. Assembly 10 is configured to be a direct replacement for a conventional PAR 38 assembly 18, as shown in FIG. 2, the operation and structure of which are well known to those skilled in the art. The various unique features contained in assembly 10 are described hereinbelow.

Figure 3:
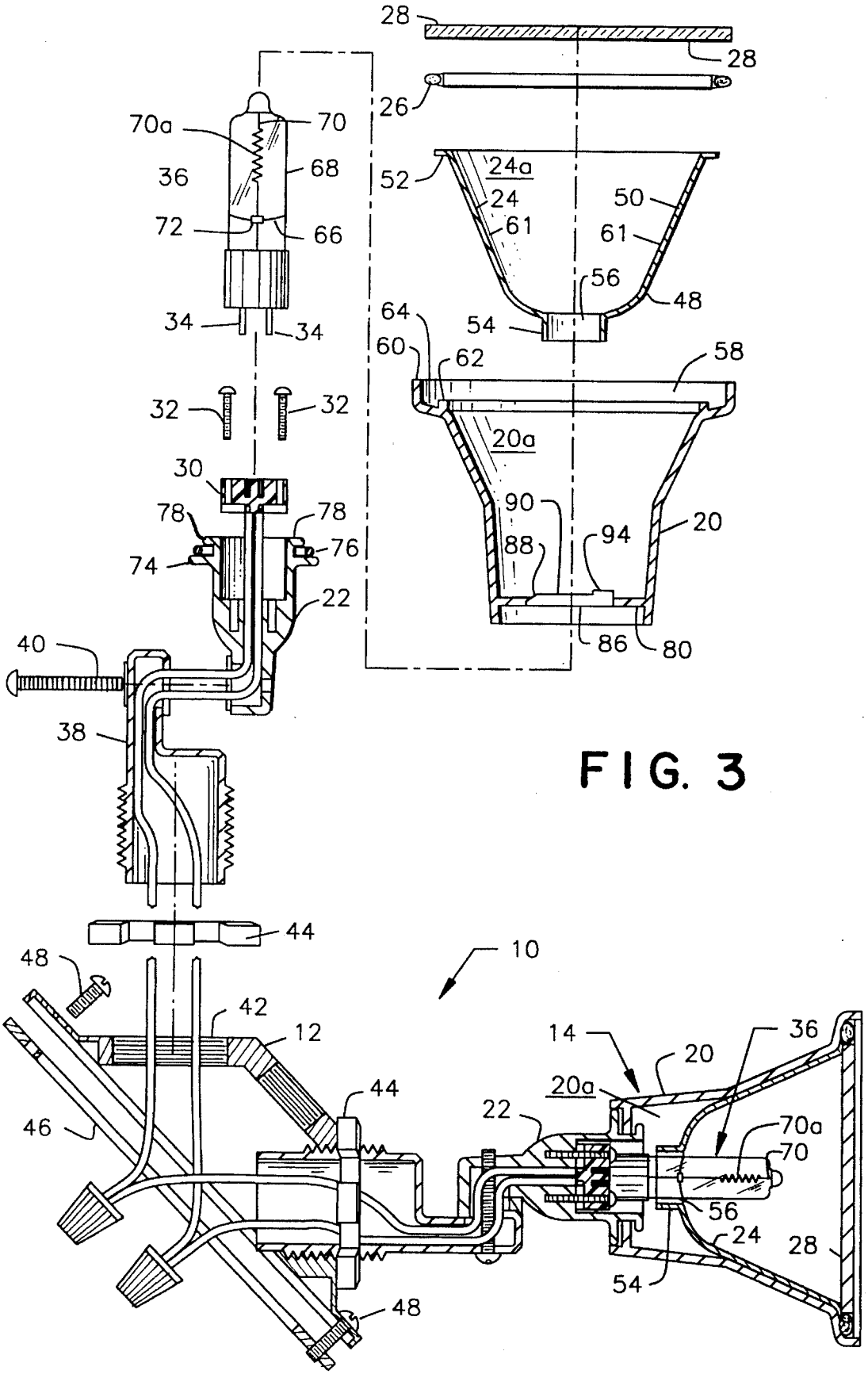
FIG. 3 is a side, sectional view, partially exploded, of the lighting assembly shown in FIG. 1, on an enlarged scale.

With reference now also to FIG. 3, each fixture 14 is shown comprising an upper housing 20 removably securable to lower housing 22. The upper housing 20 and the lower housing 22 are each preferably formed of die-cast zinc or aluminum because of their desirably high thermal conductivity properties. The lower housing 22 is also preferably formed to be of substantial mass with relatively thick walls to serve as an effective heat sink. The lower housing 22 is further recessed under the upper housing 20 and the reflector 24 to minimize the impact of radiant energy and overheating thereof, When assembled in a manner described below, upper housing 20 contains reflector 24, retained by adhesive material 26, and lens 28. Lens 28 is preferably formed of tempered glass and is generally of planar configuration. Lower housing 22 contains a receptacle 30 secured in place by screws 32, suitable for engaging electrodes 34 extending from the proximate end of lamp 36. The base end of lower housing 22 is hingedly secured to adjustment arm 38 in a conventional manner by screw 40, with arm 38 being adjustably retained within threaded hole 42 in base plate 12, and secured by lock nut 44. Base plate 12 is configured for attachment to structure 46, such as the exterior wall of a building, by screws 48. As with conventional assembly 18, each fixture 14 may be rotated and angularly adjusted as desired upon selective manipulation of adjustment arm 38, screw 40, and lock nut 44.

As best seen in FIG. 3, reflector 24 is essentially cup-shaped, having- a curved lower portion 48 and a frusto-conical upper portion 50 defining a cavity 20*a* therewithin. Reflector 24 is open at both its top and bottom ends, with an annular flange 52 extending from the perimeter of upper portion 50, and annular lip 54 extending longitudinally downwardly from the opening 56 in lower portion 48, the function of lip 54 being described below. Reflector 24 is preferably formed from drawn aluminum. The curved lower portion 48 is preferably dish-shaped, having a generally parabolic cross-section.

Figure 4:
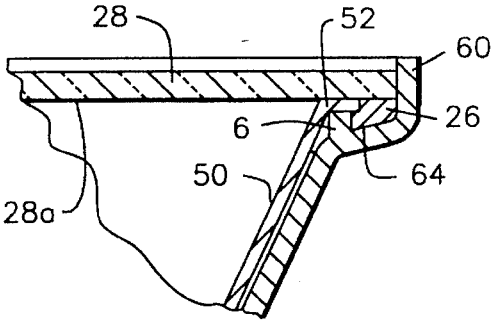
FIG. 4 is an enlarged sectional view detailing the attachment of the lens and reflector to the outer housing.
Figure 6:
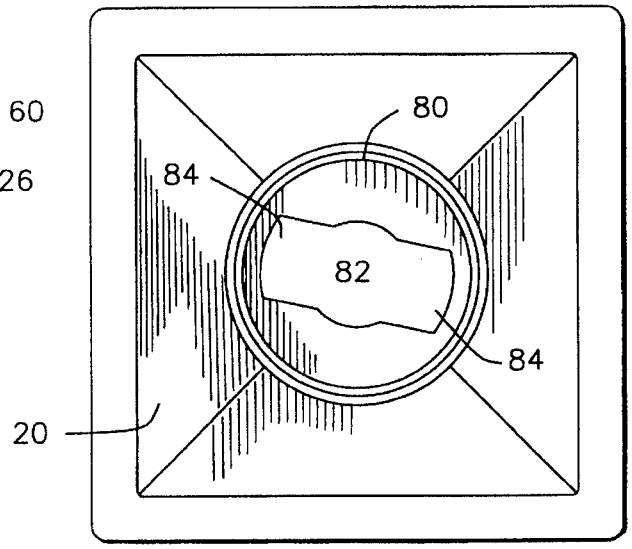
FIG. 6 is a bottom plan view of the upper housing member.

The open face 58 of upper housing 20 is bounded by an upstanding peripheral wall 60, integrally formed with side walls 61. Ridge 62 is formed inwardly from wall 60, and parallel thereto, thereby forming a channel 64 around the periphery of face 58. A unique assembly method has been devised for securing lens 28 to upper housing 20, wherein a suitable quantity of fluid, uncured adhesive material 26 is placed within channel 64, reflector 24 then placed in position with flange 52 supported by ridge 62, and lens 28 pressed into position within wall 60. As best seen in FIG. 4, adhesive material 26 effectively fills channel 64 and adheres the inner surface 28*a* of lens 28 to upper housing 20, with flange 52 sandwiched between lens 28 and ridge 62, thereby securing reflector 24. The inner surface 28*a* compresses the adhesive material 26 into the channel 64 and against the reflector flange 52. Upon curing of adhesive material 26, lens 28 and reflector 24 are operatively secured to upper housing 20, and a waterproof seal is simultaneously formed around face 58. Adhesive material 26 is preferably a silicone rubber compound, but may be any suitable compound adapted for the purpose.

Face 58 and lens 28 are preferably square, as shown herein. It is to be understood, however, that face 58 and lens 28 may be round, hexagonal, or of virtually any feasible configuration without departing from the scope of this invention.

Lamp 36 includes an internal reflector 66 operatively mounted within tubular quartz envelope 68. Filament 70 includes a coiled section 70*a* and is electrically connected to electrodes 34 in a conventional manner. Filament 70 extends longitudinally within envelope 68, passing through insulator 72 which prevents electrical contact between filament 70 and reflector 66. In the preferred embodiment shown, reflector 66 has an upwardly curved surface which generally conforms to the contour of lower curved portion 48 of reflector 24. When assembled as shown, reflector 66 substantially fills in the gap in reflector 24 caused by opening 56, thereby increasing the projection of light longitudinally outwardly through the envelope 68 toward the distal end of lamp 36. Reflector 66 may be formed from polished tungsten or any other material suitable for the purpose. Insulator 72 is preferably formed from glass or ceramic, and serves to secure reflector 66 in its operative position circumscribing a portion of filament 70. Aside from the inclusion of reflector 66 and insulator 72, lamp 36 is otherwise a conventional single-ended quartz halogen lamp, but requires no additional labor or time in assembly.

Figure 5:
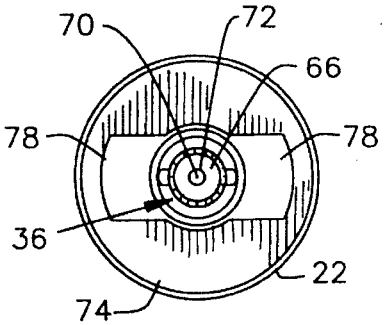
FIG. 5 is a top plan view of the lower housing member, with the lamp in place.
Figure 7:
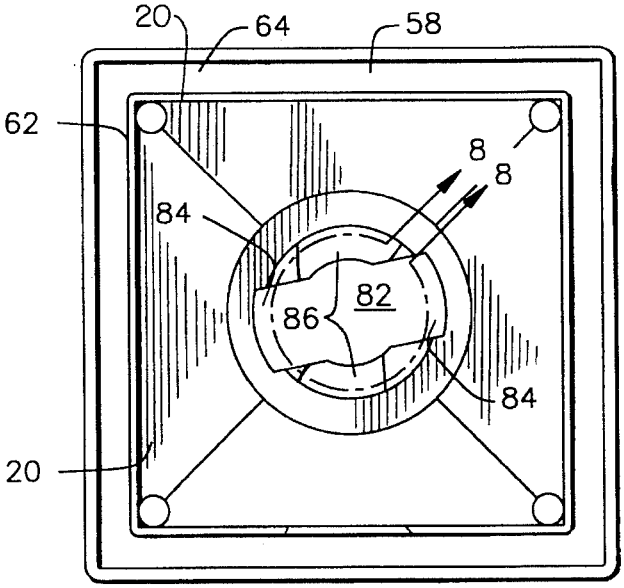
FIG. 7 is a top plan view of the upper housing member.
Figure 8:
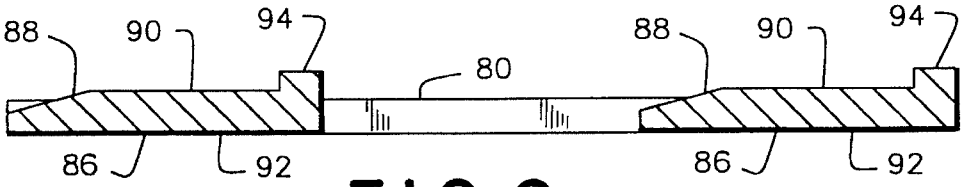
FIG. 8 is an enlarged sectional view taken along line 8—8 of FIG. 7.

Upper housing 20 and lower housing 22 are removably interconnected through a unique quarter turn fastening system. Referring now to FIGS. 3 and 5, lower housing 22 has an integrally formed annular shoulder 74 extending radially from the top, connecting end. Disposed on the top surface of shoulder 74 is seal 76. A pair of keys 78, spread 180° apart, project radially outwardly from the distal end of lower housing 22. The proximate end 80 of upper housing 20 has an opening 82 formed therein, defining a pair of keyways 84 configured to receive keys 78. As seen in FIGS. 7 and 8, the inside surface of proximate end 80 has a pair of camming ramps 86 formed thereon, spaced 180° apart and disposed annularly about opening 82 and intermediate keyways 84. Each ramp 86 includes a leading edge 88 having an inclined upper surface formed thereon, a generally flat intermediate section 90 having a substantially horizontal upper surface formed thereon, and a trailing edge 92 having a stop 94 projecting upwardly therefrom.

Assembly of upper housing 20 onto lower housing 22 is accomplished by inserting lamp 36 into opening 82 with keys 72 aligned with keyways 84, until proximate end 80 contacts seal 76. Slight additional longitudinal pressure causes proximate end 80 to resiliently compress seal 76, whereupon keys 78 are positioned within upper housing 20. The rotation of upper housing 20 (clockwise, in the preferred embodiment) slidably engages the top surfaces of camming ramps 86 with the underside surfaces of keys 78, with the rotation being limited upon keys 78 abutting stops 94. The inclined upper surfaces of leading edges 80 axially draw together upper housing 20 and lower housing 22 and facilitate the engagement of ramps 86 with keys 78 while the forces generated between intermediate portion 90 and keys 78 adequately compresses the seal 78 to form a substantially watertight junction between upper housing 20 and lower housing 22. Removal of upper housing 20 is accomplished simply by reversing the quarter-turn rotation. The relative ease of assembly and disassembly of fixture 14 greatly simplifies the replacement of lamp 36 as compared to conventional quartz halogen floodlight fixtures.

In the preferred embodiment shown, lower housing 22 includes two keys 78, and upper housing 22 includes a like number of keyways 84 and camming ramps 86. It will be readily apparent to those skilled in the art, however, that it may be possible to obtain acceptable results with a different number of keys, keyways, and camming ramps. When constructed as shown, upper housing 20 is installed and removed by rotation through an angle of 90°, i.e., a quarter turn. Obviously, this would be affected by the number of keys, keyways, and camming ramps employed.

In the preferred embodiment of this invention, the disposition of seal 76 onto the upper surface of shoulder 74 is accomplished in a novel manner. A suitable composition of adhesive material is deposited onto shoulder 74 and allowed to cure until the exposed surface is no longer tacky or adhesive while the underside adheres to shoulder 74. Upper housing 20 may then be secured to lower housing 22 as described above. The same compound for seal 76 is preferably also used for adhesive 26, thus increasing the manufacturing efficiencies over the known prior art. In the preferred arrangement the composition for seal 76 comprises silicone rubber, suitably impregnated with nitrogen bubbles in a conventional manner, to allow the cured material to be foamed for resilient compression and re-use. The amount of nitrogen will affect the resiliency of the compound in accordance with the user's requirements. Further, in a preferred manner, such foamed adhesive is cured at room temperature and atmosphere for approximately four hours.

As seen in FIG. 1, the corners 96 of lens 28 are preferably shaded, leaving only a clear circular region corresponding to the opening in reflector 24 bounded by flange 52. It has been found that tempered soda lime glass is preferable for forming lens 28, while the shading in comers 96 comprises black ceramic fired ink applied to inner surface 28*a* of lens 28 by a conventional process. It is fully expected, however, that the composition and appearance of lens 28 may be altered as desired without departing from the spirit and scope of this invention.

As mentioned above, opening 56 in lower portion 48 of reflector 24 includes a longitudinally downwardly extending lip 54, as illustrated in FIG. 3. Upon assembly of reflector 24 within cavity 20*a* of upper housing 20, opening 56 defined by annular lip 54 is substantially aligned with opening 82 so that lamp 36 may be received and properly positioned within reflector 24. Lip 54 circumscribes a portion of lamp 36, preferably the exposed portion of envelope 68 beneath reflector 66. Lip 54 therefore restricts the passage of light emanating from filament 70 into cavity 20*a* of upper housing 20, and further assists reflectors 24 and 66 in projecting the maximum amount of light outwardly in the desired direction.

The lip 54 also prevents light from heating the components disposed beneath the reflector 24 by radiation from the filament 70. Accordingly, fixture 14 is capable of operating at a lower overall housing temperature than conventional quartz halogen floodlight fixtures. Fixture 14 also projects a beam spread of approximately 120°, which is substantially greater than the 55°–60° beam spread provided by conventional PAR 38 fixtures. By combining a single ended quartz halogen lamp 36 with the uniquely formed reflector 24, fixture 14 is capable of providing superior light projection and dispersion, a longer life, and lower energy consumption than a conventional PAR 38 fixture. Further, the opening 56 in the reflector 24 does not have a sharp inner edge resulting from burrs during manufacturing as the projecting annular lip 54 allows for any such sharp edges to occur on the bottom, outside edge of the lip 54. Thus, scratching of the lamp envelope during assembly is prevented.

While the principles of an improved two-piece quartz halogen flood light assembly have been made clear from the foregoing detailed description, it is to be understood that the scope of coverage provided by this patent is to be limited only by the following claims, and not by the specific embodiment described herein. It is also to be understood that references herein to "top", "upper", "lower", and "side" structures are intended solely for purposes of providing an enabling disclosure, and in no way suggest limitations regarding the operative orientation of assembly 10 or any components thereof.

What is claimed is:

1. A sealed lighting assembly for attachment to a support structure, comprising:

a base, securable to said support structure;

a first housing member having longitudinally spaced distal and proximate ends, said distal end having an open face and said proximate end having a central hole formed therein, with a lens fixedly secured to said face;

a second housing member having a base end and a longitudinally opposed open connecting end, with a socket disposed therein for operatively retaining a lamp extending longitudinally through said open connecting end, said base end being adjustably securable to said base;

fastening means comprising cooperative keying means associated with said proximate end of said first housing member and said connecting end of said second housing member for removably interconnecting said first and second housing members, whereupon at least a portion of said lamp extends through said hole in said proximate end and is disposed within said first housing member;

first sealing means operatively disposed intermediate said lens and said distal end of said first housing member; and second sealing means operatively disposed intermediate said proximate end of said first housing member and said connecting end of said second housing member upon assembly thereof.

2. A lighting fixture according to claim 1, further comprising:

a reflector disposed within said first housing member, having a curved lower portion, a diverging side wall extending longitudinally therefrom, and an outer perimeter fixedly secured to said first housing member adjacent said lens, said lower portion having an access hole formed therein aligned with said hole in said proximate end for receiving a portion of said lamp upon assembly of said first and second housing members.

3. A lighting fixture according to claim 2, wherein:

said access hole in said reflector includes an annular lip protruding longitudinally outwardly therefrom, said lip being operative to restrict the passage of light from said lamp into a portion of said first housing member outside said reflector.

4. A lighting fixture according to claim 3, wherein:

said lip is integrally formed with said reflector.

5. A lighting fixture according to claim 1, wherein:

said first sealing means comprises a layer of silicone rubber adhesive.

6. A lighting fixture according to claim 1, wherein:

said second sealing means comprises a silicone rubber gasket.

7. A lighting fixture according to claim 1, wherein said keying means comprises:

at least one laterally extending key formed on said connecting end of said second housing member;

an annular shoulder formed on said connecting end of said second housing member beneath said key;

at least one keyway formed in said proximate end of said first housing member adjacent said hole formed therein, adapted to receive said key; and at least one camming ramp formed within said first housing member annularly about said hole in said proximate end thereof and adjacent thereto, said camming ramp being adapted to slidably engage said key, whereupon assembly of said first and second housing members is effected by seating said proximate end of said first housing member against said shoulder on said second housing member with said key passing through said keyway into said first housing member, and rotating said first housing member to slidably engage said key with said camming ramp, the interaction of said camming ramp and said key being operative to produce compressive forces between said proximate end and said shoulder, thereby retaining said first housing member in position on said second housing member.

8. A lighting fixture according to claim 7, wherein:

said second sealing means comprises a gasket operatively disposed intermediate said proximate end of said first housing member and said annular shoulder on said connecting end of said second housing member.

9. A lighting fixture according to claim 7, wherein:

said camming ramp includes a camming surface having a leading edge, and intermediate section, and a trailing edge, said leading edge being relatively sharply inclined to compress said second sealing means, said intermediate section being substantially level, and said trailing edge having a stop extending upwardly therefrom operative to prevent over-rotation of said first housing member.

10. A lighting fixture according to claim 7, wherein:

the number of said keys, said keyways, and said camming ramps is two each.

11. A sealed quartz lighting fixture for outdoor use comprising:

a two-piece separable housing, including a first housing portion and a second housing portion separably joined thereto, said first housing portion having walls defining two opposed ends with a cavity therebetween, a first opening communicating with said cavity at one end and a second opening communicating with said cavity at the other end;

a lens sealed to said first housing portion and covering said first opening;

a reflector located within said cavity and supported by said first housing walls interiorly thereof;

a lamp supported by said second housing portion and projecting through said second opening and into said cavity of said first housing portion when joined to said second housing portion and between said reflector and said lens;

a seal between said first housing portion and said second portion;

separable joining means for rotatably joining together said first housing portion and said second housing portion in less than a full revolution, said joining means cooperating with said seal to sealably join said first and second housing portions, said separable joining means being broken and said lamp being rendered accessible upon rotatably separating said first and second housing portions; and a base secured to said second housing portion, said base having a mounting surface for attachment of said fixture to an outdoor structure.

12. A sealed quartz lighting fixture according to claim 11, wherein said lens is permanently sealed to said first housing portion by an adhesive.

13. A sealed quartz lighting fixture according to claim 11, wherein said lamp is single-ended comprising an elongate quartz envelope with an electrode projecting from one end thereof, the opposing longitudinal end of said envelope being closed, said lamp envelope being disposed substantially perpendicular to said lens.

14. A sealed quartz lighting fixture according to claim 13, wherein said lens is substantially planar and is formed of tempered glass, said lamp closed end being disposed closely adjacent said lens.

15. A sealed quartz lighting fixture according to claim 11, wherein said joining means comprises a pair of laterally projecting keys on a surface of one of said first or second housing portions and a pair of alignable keyways formed on a surface of the other of said first or second housing portions to receive said keys therein.

16. A sealed quartz lighting fixture according to claim 15, wherein said joining means comprises a camming surface in cooperation with each of said keys to draw said first and second housing portions toward each other and compress said seal therebetween upon relative rotation of said first and second housing portions.

17. A sealed quartz lighting fixture according to claim 16, wherein said keys and said keyways are spaced 180 degrees apart.

18. A sealed quartz lighting fixture according to claim 17, wherein said joining means comprises a stop surface in cooperation at least one of said keys and said camming surface to effect joining of said first and second housing portions in approximately one-quarter revolution.

* * * * *